US010106943B2

(12) United States Patent
Kirchendorfer

(10) Patent No.: US 10,106,943 B2
(45) Date of Patent: Oct. 23, 2018

(54) SYSTEM, METHOD, AND APPARATUS FOR PERMEATION GROUTING

(71) Applicant: Keystone Supports, Inc., Tampa, FL (US)

(72) Inventor: Carl Kirchendorfer, Tampa, FL (US)

(73) Assignee: Keystone Supports, Inc., Tampa, FL (US)

( * ) Notice: Subject to any disclaimer, the term of this patent is extended or adjusted under 35 U.S.C. 154(b) by 58 days.

(21) Appl. No.: 15/095,400

(22) Filed: Apr. 11, 2016

(65) Prior Publication Data

US 2017/0058478 A1 Mar. 2, 2017

Related U.S. Application Data

(60) Provisional application No. 62/212,321, filed on Aug. 31, 2015.

(51) Int. Cl.
*E02D 3/12* (2006.01)
*E02D 5/46* (2006.01)

(52) U.S. Cl.
CPC ..... *E02D 3/12* (2013.01); *E02D 5/46* (2013.01)

(58) Field of Classification Search
CPC .... E02D 3/12; E02D 5/34; E02D 5/38; E02D 5/42
USPC ..... 405/266–270, 230, 128.45, 128.5, 128.7, 405/128.75; 47/48.5; 111/7.1; 239/271, 239/310, 201, 276, 547; 404/78; 169/70
See application file for complete search history.

(56) References Cited

U.S. PATENT DOCUMENTS 6,634,831 B2 10/2003 Canteri
2011/0110727 A1* 5/2011 Plahert ..... E02D 3/12 405/269

FOREIGN PATENT DOCUMENTS

JP 61261514 A * 11/1986

OTHER PUBLICATIONS

"Polyurethane Resin (PUR) Injection for Rock Mass and Structure Stabilization", 2008, 13 pages.*

* cited by examiner

*Primary Examiner* — Sunil Singh
(74) *Attorney, Agent, or Firm* — Larson & Larson, P.A.; Frank Liebenow; Justin P. Miller

(57) ABSTRACT

An apparatus for remediation of soil includes a drum for storing chemical-permeation grout and a pump for pumping the chemical-permeation grout at a low pressure into a manchette delivery tube while the manchette delivery tube is inserted into the soil. There is a valve for controlling the low pressure and a meter for metering an amount of the chemical-permeation grout that is delivered into the soil.

11 Claims, 4 Drawing Sheets

SYSTEM, METHOD, AND APPARATUS FOR PERMEATION GROUTING

CROSS-REFERENCE TO RELATED APPLICATION

This application claims the benefit of U.S. provisional application No. 62/212,321 filed on Aug. 31, 2015, the disclosure of which is incorporated by reference.

FIELD

This invention relates to the field of Civil Engineering and Geotechnical Construction Methods, and more particularly to a system/method for permeation grouting.

BACKGROUND

Permeation grouting is typically used to improve the structural characteristics of the soil, as well as several secondary uses such as reducing soil permeability, improving soil cohesion, or, a combination of such. Permeation grouting is sometimes performed by injecting any of a variety of grouts into the soil to permeate into void spaces and connect individual soil grains without otherwise disturbing the natural state of the soil.

Chemical-permeation grouts have been used for decades in applications ranging from water stops to soil densification. The behavior of chemical-permeation grouts, once injected into a soil medium, is difficult to model and understand. The injection of chemical-permeation grouts was once promoted as "BLACK MAGIC" that only certain contractors were capable of doing, but is now a respectable branch of the ground modification arsenal available to today's Civil Engineers and geotechnical contractors. Chemical grouting was introduced as a means to treat the soil profiles that could not be addressed by compaction or intrusion grouting. Prior to the introduction of chemical grouting for soil stabilization, contractors were limited to slurry grouting. Slurry grouting is a type of permeation grouting using the injection of cement grout of a high slump under lower pressure in an attempt to permeate the void spaces between soil grains and bind the soil matrix together. Slurry grouting is a very messy process. Additionally, achieving permeation of the void spaces between soil grains with slurry grout had limitations due to the nature of the grout material properties. Slurry grout is a suspension of cement particles that must flow into the void spaces between the soil grains in order to be effective. The interaction of the suspended particles and the soil grains restricts the amount of grout that will permeate effectively.

A more efficient solution is to introduce a chemical grout comprised of low-viscosity fluid instead of a suspension of particles to increase the magnitude of permeation and allow a larger area of influence at each injection location. Although permeation grouting with chemical-permeation grouts has been performed in the past, the existing delivery systems are poorly suited to the application in various soils. The common method for the injection of chemical-permeation grout utilizes an airless paint spray pump attached to an injection pipe with a single opening below grade at the injection depth. The only controls available for injection are basically "ON/OFF". Under these equipment limitations, there is no accountability, no recordable data except estimates of injected volumes and no ability for the Engineer of Record to adjust the injection protocol to achieve site-specific goals. Some available models of airless paint sprayers have adjustable pressure outputs, but do not precisely control or measure injection pressures. As such, permeation grout is injected at pressures of up to 3000 psi, without the contractor or the Engineer having any knowledge or control of the injection pressure. The permeation grout is typically injected in small batches, usually five gallon buckets. Having an open system (open bucket) subjects the permeation grout to moisture that often leads to premature gel formation of the material in the bucket, in the sprayer, in the lines, etc. As the chemical-permeation grout gels prior to introduction into the soil mass, permeation often becomes hindered to the point that very low grout takes are recorded even in the most permeable soils. Data typically shows either very low grout takes (due to premature gel formation), very high grout takes (due to extreme injection pressures) or, worse yet, a combination of the two at a single site. Without reliable data and precise injection controls, the Engineer of Record has no mechanism to differentiate between a failed injection attempt, a very dense in-situ soil, a large subsurface void or soil that has been literally blown apart and then replaced by grout.

Approximately a decade ago, two-part polyurethane foams were introduced as a solution to some such issues. Since then, two-part polyurethane foams have gained popularity very quickly and dominated the shallow soil stabilization market.

Originally, 2-part polyurethane foam injection was developed for void filling at the soil-to-slab interface and for lifting and leveling of light structures. In these applications, 2-part polyurethane foams are far superior to any other product on the market. As the search for available soil densification techniques widened, 2-part polyurethane foams were selected for injection below grade to increase bearing capacity via displacement. The thought was: inject bulbs of rapidly expanding chemical grout at discrete locations and depths where the polyurethane foam would expand rapidly to displace loose soils and compact the soils within the immediate vicinity of the grout bulb. One such system is described in U.S. Pat. No. 6,634,831. Many residential buildings received the 2-part polyurethane injections as disclosed in this patent to stabilize loose granular soils as part of sinkhole remediation packages.

When treating soils with chemical grout, it is desired to limit further harm to any existing soil structure. The golden rule of "do not disturb the soil" is the guiding parameter. At low pressure the physical properties of the permeation grout achieves the desired soil modifications, but permeation is low. Uncontrollable, high-pressure applications are utilized in an attempt to 'force' permeation or induce displacement of in-situ soils. High pressure injection (in excess of 150 psi) is sometimes detrimental to the soil profile except in instances where the Engineer of Record wishes to cause soil fractures (as in the case of lens grouting or fracture grouting). The 2-part polyurethane foams (one part plastic and one part reactor) are commonly injected at pressures that induce soil fractures and cause the chemical grout to migrate away from the location being treated. Once the soil is fractured, there is no way to predict the final location of the injected grout. To exacerbate the problem, once the rapidly expanding foam product is injected into a formed fracture, the expansion of the product pushes the fracture to spread to even greater distances and then forces the fracture apart. The use of 2-part polyurethane foams for densification and increased bearing capacity is flawed in the same aspects that the early delivery systems for permeation grouting were flawed.

In order to achieve the desired modifications in, for example, a granular soil profile, a new process is needed.

SUMMARY

In one embodiment, a method of soil remediation is disclosed including (a) hydrating the soil by inserting a manchette delivery tube having a plurality of side exit orifices into the soil to a desired depth and injecting water through the side exit orifices. Next, (b) connecting the permeation grout apparatus to the manchette delivery tube at the location where hydrating was performed and (c) delivering a metered amount of permeation grout through the manchette delivery tube at a low pressure. After delivery, (d) the manchette delivery tube is pulled out of the soil a distance; and (e) steps (c) and (d) are repeated until the side exit orifices of the manchette reach compacted soil.

In another embodiment, an apparatus for remediation of soil is disclosed including a source of compressed air and a drum for storing chemical-permeation grout. An air-driven pump is provided for pumping the chemical-permeation grout from the drum at a pressure (e.g., 100 PSI) into a manchette delivery tube. A valve is fluidly inserted between the source of compressed air and the air-driven pump for controlling a pressure of the compressed air delivered to the air-driven pump and, therefore, the valve controls the pressure of the chemical-permeation grout delivered to the manchette delivery tube.

In another embodiment, an apparatus for remediation of soil is disclosed including a drum for storing chemical-permeation grout and a pump for pumping the chemical permeation grout at a low pressure into a manchette delivery tube while the manchette delivery tube is inserted into the soil. There is a valve for controlling the low pressure and a meter for metering an amount of the chemical-permeation grout that is delivered into the soil.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
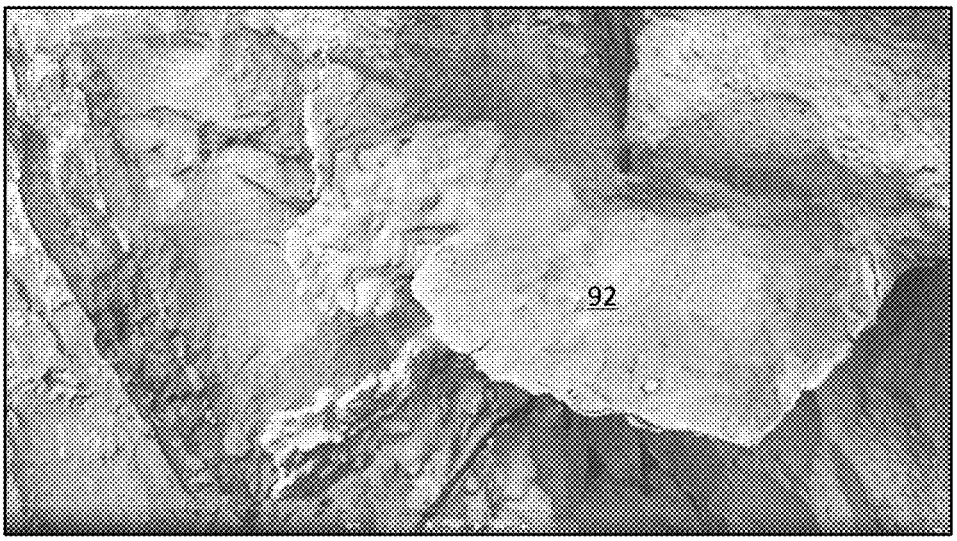
FIG. 1 (Prior Art)
FIG. 1 illustrates an excavated injection of an uncontrolled two-part injection system of the prior art.

Reference will now be made in detail to the presently preferred embodiments of the invention, examples of which are illustrated in the accompanying drawings. Throughout the following detailed description, the same reference numerals refer to the same elements in all figures.

The disclosed method and apparatus for permeation grouting uses low viscosity chemical grouts to affect the soil repair. Under the method, permeation grouting is not 'forced' by excessive pressure.

When treating soils with chemical grout, it is desired to limit further harm to any existing soil structure. The golden rule of "do not disturb the soil" is the guiding parameter. At low pressure the physical properties of the permeation grout achieves the desired soil modifications, but permeation is low. To achieve higher permeation, uncontrolled, high-pressure systems have been utilized in an attempt to 'force' permeation or induce displacement of in-situ soils. High pressure injection (e.g., in excess of 150 psi) is detrimental to the soil profile except in instances where the Engineer of Record wishes to cause soil fractures (as in the case of lens grouting or fracture grouting). The 2-part polyurethane foams (one part plastic and one part reactor) are commonly injected at pressures that induce soil fractures and cause the chemical grout to migrate away from the location being treated. Once the soil is fractured as shown by the fracture remnant 92 of FIG. 1, there is no way to predict the final location of the injected grout. To exacerbate the problem, once the rapidly expanding foam product is injected into a formed fracture, the expansion of the product pushes the fracture, spreading the fracture to even greater distances and then forcing the fracture further apart. The use of 2-part polyurethane foams for densification and increased bearing capacity is flawed in the same aspects that the early delivery systems for permeation grouting were flawed.

Figure 2:
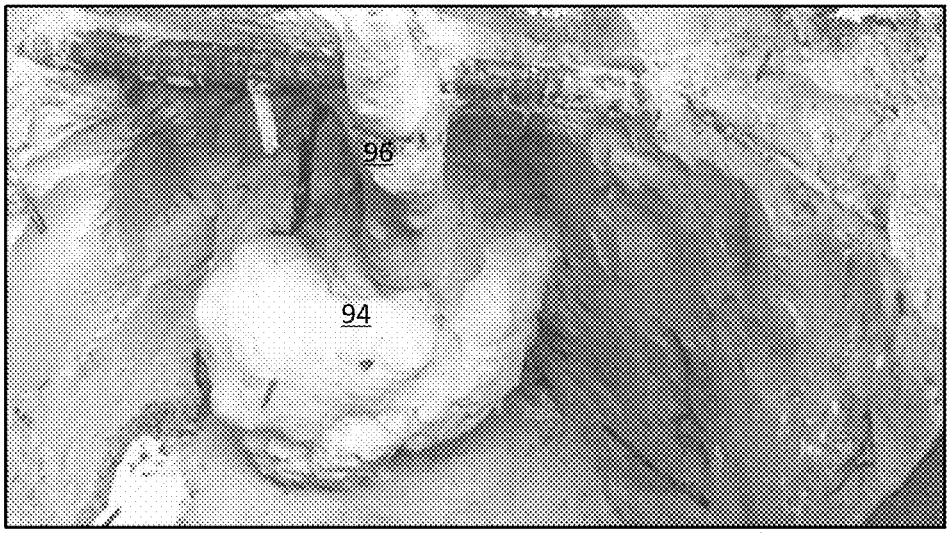
FIG. 2 illustrates an excavated injection of a controlled one-part injection system completed at the same site, and in similar soil conditions, as present in FIG. 1.

In FIG. 2, a sample of a soil permeation delivered by a delivery system of the present invention is shown. The highly controllable and recordable delivery system provides for the injection of permeation grout at precise pressures while monitoring flow rates to determine the parameters of the soil being grouted as well as the effectiveness of the grouting operation. By permeation grouting using the disclosed apparatus and materials, the following advantages are attained:

1) A complete control over injection depth, pressures, quantities, etc. is provided.

2) Pressure and flow data are communicated in real time.

3) Injection parameters are precise—providing defendable documentation.

4) Grout quantities are limited to what the soil can accept, therefore grout is not jetted into the ground.

5) Permeation grouting results in a grout/soil matrix that is durable and environmentally inert.

6) Excess lateral grout travel is limited by lower pressure injections.

7) The use of manchette pipes delivers grout to a zone rather than a discrete depth and location.

8) Completely closed system eliminates premature gel formation.

As shown in FIG. 2, a void has been filled by the injected material 94 and a column 96 has been created emanating from the filled area 94, formed as the manchette delivery tube 40 (see FIG. 5) is slowly pulled upwardly, out of the soil.

Figure 3:
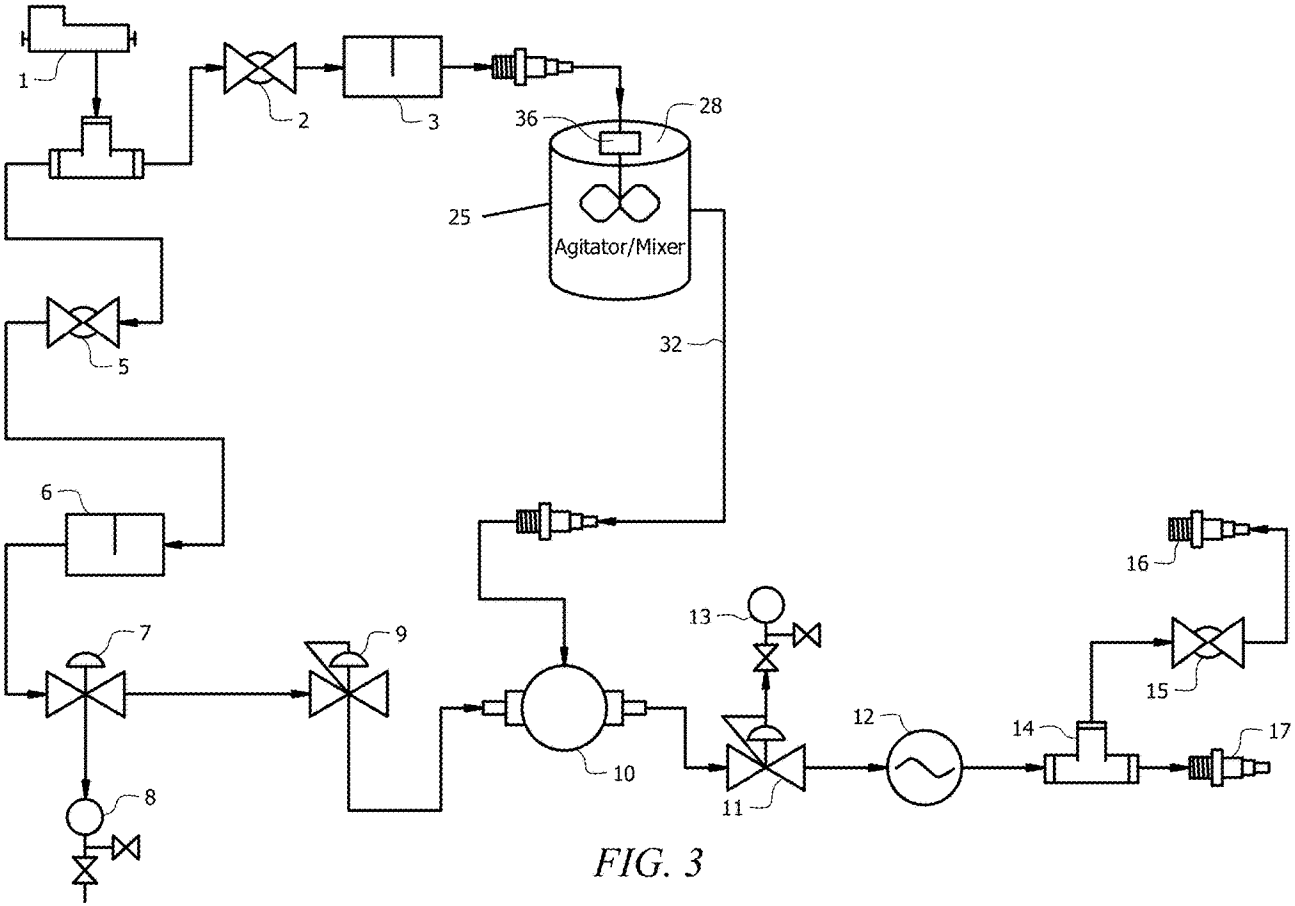
FIG. 3 illustrates a schematic view of an injection control system.

Referring to FIG. 3, a schematic view of an injection control system is shown. The exemplary system shown in FIG. 3 is driven by an air compressor 1. Although there is no restriction on the type and capacity of the air compressor 1, a gas-driven air compressor 1 is typically used for operation in the field, for example, a 14 HP reciprocating air compressor that delivers air flows of approximately 22.5 cubic feet per minute at 175 pounds per square inch.

Pressurized air from the compressor 1 branches in two paths by a T-fitting. The pressurized air passes through a first valve 2 and through a water separator/oiler 3 and is routed to the agitator/mixer 36 on the custom lid 28 that is mounted atop a drum 25 filled with the chemical grout (e.g., a single-part polyurethane material). The first valve 2 controls the pressure to the water separator/oiler 3 and, therefore, to the agitator/mixer 36. Opening of the first valve 2 initiates agitation (e.g., stirring) of the chemical grout.

Pressurized air from the compressor 1 also passes through a second valve 5 and through a water separator 6 and is routed to the pressure control valve 7 and first pressure gauge 8. The pressure control valve 7 modules/controls air pressure to the pump 10 and the first pressure gauge 8 provides a reading of the air pressure for an operator to read. The pressure control valve 7 sets the inlet pressure for a diaphragm of the pump 10 (preferably a diaphragm pump or double diaphragm pump, though any pump is anticipated), thereby controlling injection pressure of the material (e.g., single-part polyurethane material). As the pressure control valve 7 is opened more, the pressure to the pump 10 increases, and the pump 10 provides higher pressure of the chemical grout.

The runaway safety valve 9 protects the pump 10 from both back pressure and over-cycling in the event of rapid changes in subsurface soil conditions.

The inlet feed of the pump 10 is attached to the siphon port 32 for receiving permeation grout material (e.g., single-part polyurethane material) from the drum 25. Permeation grout material flows through the pump 10, through a high pressure regulator valve 11 and into a digital flow rate/volume meter 12. The high pressure regulator valve 11 regulates flow via, for example, a spindle valve. The digital flow rate/volume meter 12 digitally reports flow rates and injection volumes, for example, down to the ounce and, in some embodiments, wirelessly sends the data to a compatible laptop, smartphone, or data recording device (not shown). The permeation grout material (e.g., single-part polyurethane material) then passes a tee fitting and connects to ground permeation insertion devices (see FIG. 5) through an injection hose by an outlet 17 (e.g., a quick-connect fitting). Note that the particular connection system is shown as an example, as other connection mechanisms are anticipated as well as different ordering of serially connected components. For example, the system works equally as well having the first valve 2 and the water separator/oiler 3 in opposite order.

One output of the tee fitting 14 has a ball valve 15 for bypass flow for bleeding of system air, recirculation of permeation grout material (e.g., single-part polyurethane material) during pump halting periods and other associated processes where the outlet 17 is to be bypassed. The second output of the tee fitting connects to an outlet 17 (e.g., a quick connect fitting) that accepts a mating quick connect fitting of a delivery hose. A second pressure gauge 13 monitors the output pressure from the pump 10.

Figure 4:
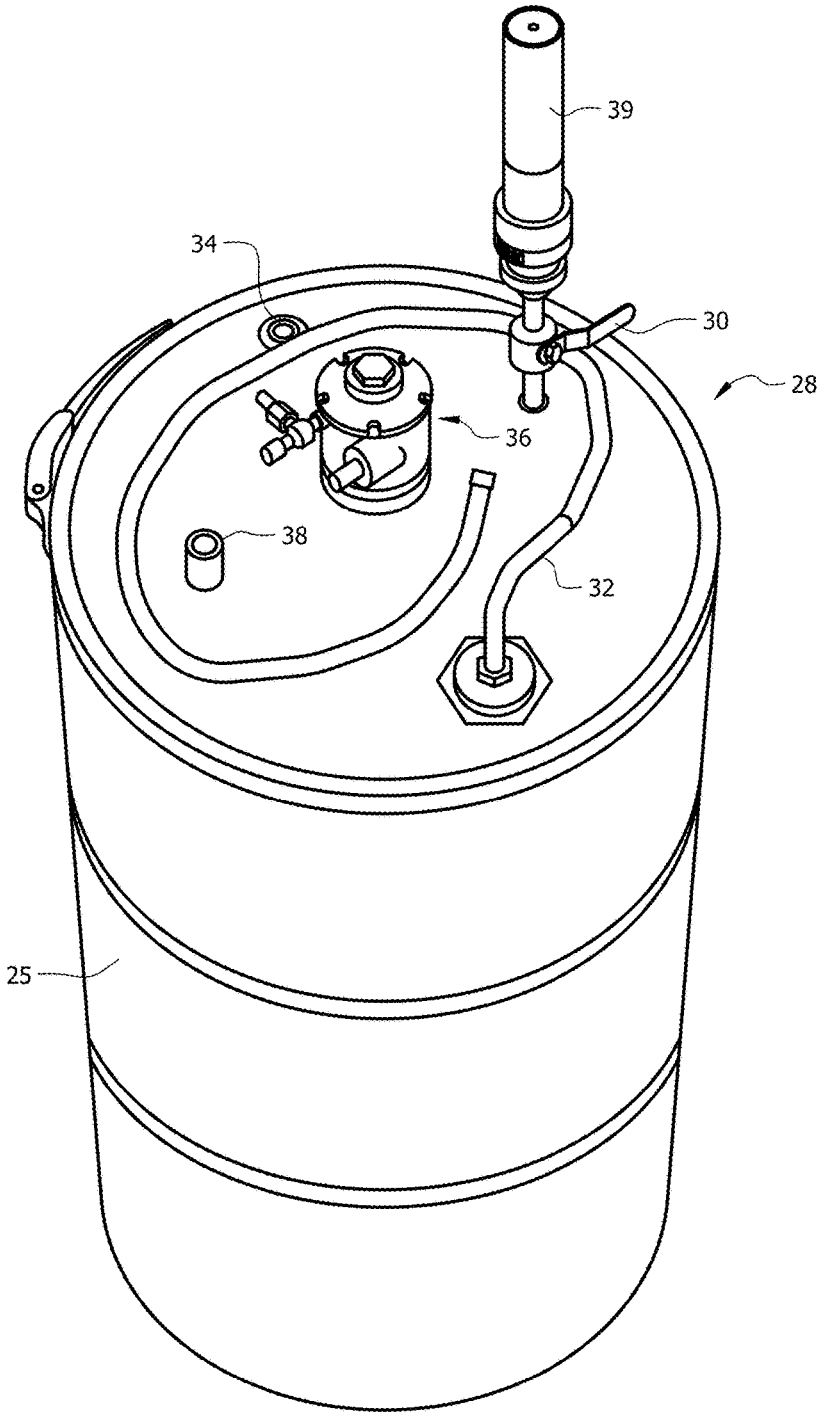
FIG. 4 illustrates an isometric view of the custom material delivery drum.

Referring to FIG. 4, a plan view of the custom material delivery drum 28 is shown. One of the most difficult aspects of working with many chemical permeation grouts is that moisture is the catalyst for the reaction (e.g., gelling, setting and curing of the single-part polyurethane material). Premature gel formation or an increase in material viscosity leads to tremendous variability at a single site as well as fouling of pumps, lines and injection tubes. To reduce introduction of moisture into the chemical-permeation grout material, a completely closed system is used. The raw materials are delivered in sealed 55 gallon drums 25. The custom drum lid 28 shown in FIG. 4 incorporates an agitator 36, a siphon 32, a recycle port 38, and a relief valve 30 with a desiccant canister 39. In a preferred embodiment, connections are of the hydraulic, quick-connect variety. An additional nitrogen injection port 34 is optionally included for injection of dry nitrogen for mix designs that contain accelerants. Using this lid, exposure of the chemical grout material to air (and hence, moisture) is limited to the time required for removal of the shipping lid (not shown) until the installation of the custom lid 28, estimated to be approximately 10 seconds. Any moisture introduced during the installation of the custom lid 28 is absorbed by the desiccant canister 39 while the material is agitated or stirred by the agitator 36, which is preferably a compressed-air driven agitator 36.

Figure 5:
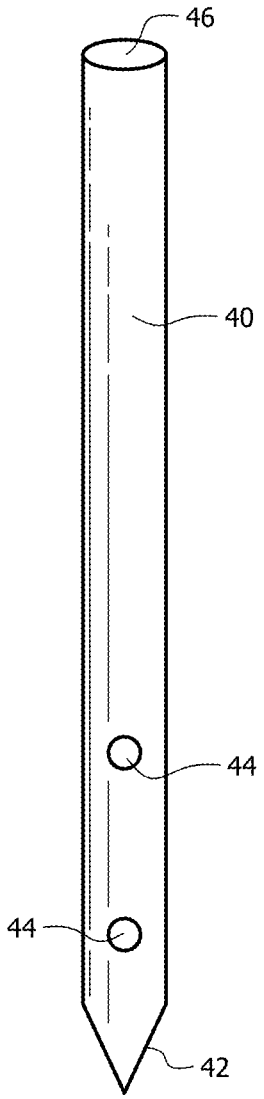
FIG. 5 illustrates an isometric view of the manchette delivery tubes.

Referring to FIG. 5, a plan view of a manchette delivery tube 40 is shown. Injection of the permeation grout material (e.g., single-part polyurethane material) is performed with a manchette delivery tube 40 that is inserted into the soil at the desired depth. Preferably, the manchette delivery tube 40 has a pointed tip 42 to aid and facilitate insertion into the soil. The manchette delivery tube 40 is hollow for supplying of the permeation grout material (e.g., single-part polyurethane material) from an input orifice 46 (typically connected to a delivery hose). The input orifice is in fluid communications with one or more exit orifices 44 arranged near the tip-end of the manchette delivery tube 40. In some embodiments, the manchette delivery tube 40 is made of steel.

It is preferred, though not required, that the manchette delivery tube 40 is cross-drilled with ⅛-inch diameter holes 44 every six inches along the length, at an alternating rotation of 90° each interval for a total of 16 inches up from the tip 42. This design parameter provides a 33% overlap of injection zones when retracting the injection pipe upwards in one-foot intervals for successive injection zones at decreasing depths. Research has shown that this injection pipe design affords a predictable and repeatable column shape and size (e.g., as shown in FIG. 2).

In an example of method of soil permeation grouting using the injection control system shown in FIG. 3, the soil is first hydrated by injecting water (e.g., tap water, river water, etc.) into the soil that is to be treated, for example, inserting the manchette delivery tube 40 attached to a water line.

Next, a delivery hose is connected to the input orifice 46 of the manchette delivery tube 40 and manchette delivery tube 40 is inserted into the site where remediation is needed. The manchette delivery tube 40 is inserted into the soil to the depth determined by the engineer. The injection control system is operated to deliver permeation grout material (e.g., single-part polyurethane material) through the manchette delivery tube 40 and into the soil surrounding the outlet holes 44 of the manchette delivery tube 40. The manchette delivery tube 40 is then pulled partly out of the soil and this is repeated until the manchette outlet holes 44 reach the compacted soil area, at which time the pump 10 is stopped and the manchette delivery tube 40 is removed from the soil.

By controlling the delivery pressure, by using a low-expansion permeation grout material (e.g., single-part polyurethane material), and by injecting with the described manchette delivery tube 40, the permeation grout material (e.g., single-part polyurethane material) is injected in a relatively neat column, filling voids, but not creating fractures in areas where the soil is already sturdy. As the permeation grout material (e.g., single-part polyurethane material) is exposed to moisture in the soil, the permeation grout material (e.g., single-part polyurethane material) reacts to improve the structural stability of the soil.

By injecting at low pressure and volume (e.g. approximately two gallons for a 5 foot to 3.5 foot injection at approximately 100 PSI), there is less disturbance of any sub-surface soil structure and less fracturing of sub-surface soil than previous methods using high-pressure injection (e.g., 1500-3000 PSI). Further, by using the exemplary permeation grout material (e.g., single-part polyurethane material) that expands at a rate of approximately 3:1, less soil fracturing results compared with using two-part materials (e.g., a plastic and a reactant) which expand at a rate of perhaps 1000:1.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An apparatus for remediation of soil, the apparatus comprising:

a drum for storing chemical-permeation grout;

means for pumping the chemical-permeation grout at a low pressure of less than or equal to 150 PSI into a manchette delivery tube while the manchette delivery tube is inserted into the soil;

means for controlling the low pressure;

means for metering an amount of the chemical-permeation grout that is delivered into the soil; and an agitator interfaced to the drum, the agitator for mixing and agitating the chemical-permeation grout that is stored within the drum, the drum includes a custom lid, the agitator is mounted on the custom lid;

wherein the agitator is driven by compressed air, a speed of agitation provided by a valve fluidly inserted between a source of the compressed air and the agitator.

2. The apparatus of claim 1, wherein the low pressure is approximately 100 PSI.

3. The apparatus of claim 1, wherein the chemical-permeation grout is a single-part polyurethane that sets when exposed to water.

4. The apparatus of claim 1, wherein the means for pumping comprises an air driven pump, the air driven pump operated by a controlled amount of air pressure delivered from the source of the compressed air through the means for controlling, the means for controlling being a control valve, an input of the air driven pump in fluid communications with the drum for storing chemical-permeation grout for receiving chemical-permeation grout from the drum for storing chemical-permeation grout, and an output of the air driven pump in fluid communications with the manchette delivery tube.

5. The apparatus of claim 4, wherein the means for metering comprises a digital flow rate/volume meter fluidly interfaced between the air driven pump and the manchette delivery tube, thereby counting a volume of the chemical-permeation grout that is delivered to the manchette delivery tube.

6. The method of claim 1, wherein the chemical-permeation grout is a single-part polyurethane that reacts when exposed to water.

7. An apparatus for remediation of soil, the apparatus comprising:

a source of compressed air;

a drum for storing chemical-permeation grout;

an air-driven pump for pumping the chemical-permeation grout from the drum at a pressure into a manchette delivery tube;

a valve fluidly inserted between the source of compressed air and the air-driven pump, the valve controlling a pressure of the compressed air delivered to the air-driven pump and, therefore, the valve controlling the pressure of the chemical-permeation grout delivered to the manchette delivery tube;

an agitator interfaced to the drum, the agitator mixing and agitating the chemical-permeation grout that is stored within the drum, the drum includes a custom lid, the agitator mounted on the custom lid;

wherein the pressure is less than 150 PSI and wherein the agitator is driven by the compressed air, a speed of agitation provided by a valve fluidly inserted between the source of the compressed air and the agitator.

8. The apparatus of claim 7, further comprising a digital flow rate/volume meter fluidly interfaced between the air driven pump and the manchette delivery tube for metering an amount of the chemical-permeation grout that is delivered to the manchette delivery tube.

9. The apparatus of claim 7, further comprising a desiccant canister mounted to the custom lid of the drum, the desiccant canister containing desiccant for absorption of moisture from within the drum.

10. The apparatus of claim 7, wherein the pressure is approximately 100 PSI.

11. The apparatus of claim 7, wherein the chemical-permeation grout is a single-part polyurethane that sets when exposed to water.

* * * * *